US012290120B2

(12) United States Patent
Rybak

(10) Patent No.: US 12,290,120 B2
(45) Date of Patent: May 6, 2025

(54) OUTERWEAR HAVING ENHANCED HOOD

(71) Applicant: Miroslav Rybak, Putnam Valley, NY (US)

(72) Inventor: Miroslav Rybak, Putnam Valley, NY (US)

(73) Assignee: Miroslav Rybak, Putnam Valley, NY (US)

( * ) Notice: Subject to any disclaimer, the term of this patent is extended or adjusted under 35 U.S.C. 154(b) by 83 days.

(21) Appl. No.: 17/955,145

(22) Filed: Sep. 28, 2022

(65) Prior Publication Data

US 2023/0329364 A1 Oct. 19, 2023

Related U.S. Application Data

(63) Continuation-in-part of application No. 16/924,484, filed on Jul. 9, 2020, now Pat. No. 11,672,286, which is a continuation of application No. 15/843,386, filed on Dec. 15, 2017, now Pat. No. 10,743,593.

(60) Provisional application No. 62/442,275, filed on Jan. 4, 2017.

(51) Int. Cl.

| | |
|---|---|
| ***A41D 3/00*** | (2006.01) |
| ***A41B 7/00*** | (2006.01) |
| ***A41D 27/04*** | (2006.01) |
| ***A41D 27/10*** | (2006.01) |
| ***A42B 1/04*** | (2021.01) |
| ***A42B 1/048*** | (2021.01) |

(52) U.S. Cl.

CPC ..... *A41D 3/00* (2013.01); *A41B 7/00* (2013.01); *A41D 27/04* (2013.01); *A41D 27/10* (2013.01); *A42B 1/04* (2013.01); *A42B 1/048* (2013.01); *A41D 2200/20* (2013.01); *A41D 2300/33* (2013.01); *A41D 2400/44* (2013.01)

(58) Field of Classification Search

CPC ..... A41D 2200/20; A41D 3/00; A41D 3/02; A41D 2300/33; A41D 2400/44; A41D 1/02; A41F 1/002; A42B 1/04

See application file for complete search history.

(56) References Cited

U.S. PATENT DOCUMENTS

| | | | | |
|---|---|---|---|---|
| 6,339,865 | B1 * | 1/2002 | Takahashi | F16G 11/101 24/306 |
| 2016/0270467 | A1 * | 9/2016 | Munson | A41F 1/002 |
| 2018/0184729 | A1 * | 7/2018 | Rybak | A41D 3/00 |
| 2022/0007767 | A1 * | 1/2022 | Harris | A41F 1/002 |

* cited by examiner

*Primary Examiner* — F Griffin Hall

(57) ABSTRACT

The present application provides a garment that includes: a sleeve, a cuff, a retainer, and a sleeve lining attached at one end thereof at a proximal end of the sleeve, the sleeve lining extendible outward sufficient to cover at least a portion of a wearer's hand and retractable inward at a distal end of the sleeve; the retainer having a first end attached at the distal end of the sleeve to the sleeve and the sleeve lining, wherein the retainer is configured to limit at least the retractable inward movement of the sleeve lining; the cuff is located at the distal end of the sleeve lining and comprises a padding removably coupled to the cuff at a location proximate to the wearer's palm.

14 Claims, 8 Drawing Sheets

OUTERWEAR HAVING ENHANCED HOOD

CROSS-REFERENCE TO RELATED APPLICATIONS

This patent application is a continuation-in-part of U.S. patent application Ser. No. 16/924,484, filed Jul. 9, 2020, entitled "OUTERWEAR HAVING ENHANCED HOOD," which is a continuation of U.S. patent application Ser. No. 15/843,386, filed Dec. 15, 2017, entitled "OUTERWEAR HAVING ENHANCED HOOD," which application claims priority to U.S. Provisional Patent Application No. 62/442,275, filed on Jan. 4, 2017, entitled "OUTERWEAR HAVING ENHANCED HOOD," the disclosures of which are incorporated herein by reference in their entirety.

BACKGROUND

This patent application relates to clothing and more particularly outdoor garments.

While jackets having hoods of various configurations and methods of use are well known, existing methods of controlling the positioning of a hood and other appendages extending from the main body of the garment requires either the use of both wearer's hands or the use of a single hand but in a complicated manner. There remains a need for alternative mechanisms of controlling a hood or other appendage of a garment with greater simplicity and convenience to the wearer.

SUMMARY OF THE INVENTION

The present application provides a garment that includes a torso portion having an upper end; a hood attached to the upper end of the torso portion, the hood having a passage therein with a first opening and a second opening at about a neck of the hood; a drawstring extending outward from the first opening and the second opening; at least a first set of catch plates attached to the torso portion at a front end thereof; a first slider slidingly coupled to a first end of the drawstring and a second slider slidingly coupled to a second end of the drawstring, the first and second sliders configured to magnetically secure the first and second drawstring ends to the first set of catch plates.

In one embodiment, the garment includes a second set of catch plates attached to the torso portion at a front end thereof, vertically below the first set of catch plates.

In one embodiment, the garment includes a cord stopper attached to each of the first and second drawstrings at a terminal end thereof.

In one embodiment, the garment includes a cord lock attached to each of the first and second drawstrings.

In one embodiment, the first and second sliders are located between the respective cord lock and a cord stopper attached to each of the first and second drawstrings at a terminal end thereof.

In one embodiment, the first set of catch plates are attached to the torso portion laterally on either side of a zipper.

In one embodiment, the first set of catch plates are attached to the torso portion vertically below the first opening and the second opening.

In one embodiment, the first slider and the second slider are slidingly coupled to the drawstring with a resistance fit to prevent the slider from dropping along the drawstring based on its own weight.

In one embodiment, the passage meanders from the first opening in a concave shape on at least a first side of the hood and extending from a bottom front of the hood, rearward over a wearer's shoulder when the hood is worn by a wearer, transitions vertically toward a top of the hood, and continues at the top of the hood forward back over the wearer's shoulder toward the front of the hood when the hood is worn by the wearer, and terminates at a front edge of a brim of the hood, and wherein at least a portion of the drawstring is disposed within the passage.

In one embodiment, the passage meanders from the second opening in a concave shape on at least a side of the hood opposite the first side of the hood and extending from the bottom front of the hood, rearward over a wearer's shoulder when the hood is worn by the wearer, transitions vertically toward the top of the hood, and continues at the top of the hood forward back over the wearer's shoulder toward the front of the hood when the hood is worn by the wearer, and terminates at the front edge of a brim of the hood.

In one embodiment, the passage on the first side has a curvature that mirrors a curvature of the opposite passage.

In one embodiment, the drawstring comprises a pair of drawstring halves each detachably connected at a front edge of a brim of the hood.

In one embodiment, the garment includes a sleeve and a sleeve lining attached at one end thereof to the sleeve at a proximal end of the sleeve, the sleeve lining extendible outward sufficient to cover at least a portion of a wearer's hand and configured to be retractable inward at a distal end of the sleeve.

In one embodiment, the garment includes a retainer having a first end attached at the distal end of the sleeve to the sleeve and to the sleeve lining, the retainer limiting at least retractable inward movement of the sleeve lining.

In one embodiment, the garment includes a cuff at the distal end of the sleeve lining.

In one embodiment, the cuff comprising padding adapted to be disposed about the wearer's palm.

In one embodiment, the padding is removably coupled to the cuff.

DETAILED DESCRIPTION

The present application relates to garments with one or more appendages, such as a hood, sleeve, etc. Although the description herein may refer to a jacket by way of example, it is understood that the inventive concepts discussed herein are not limited only to jackets.

Figure 1:
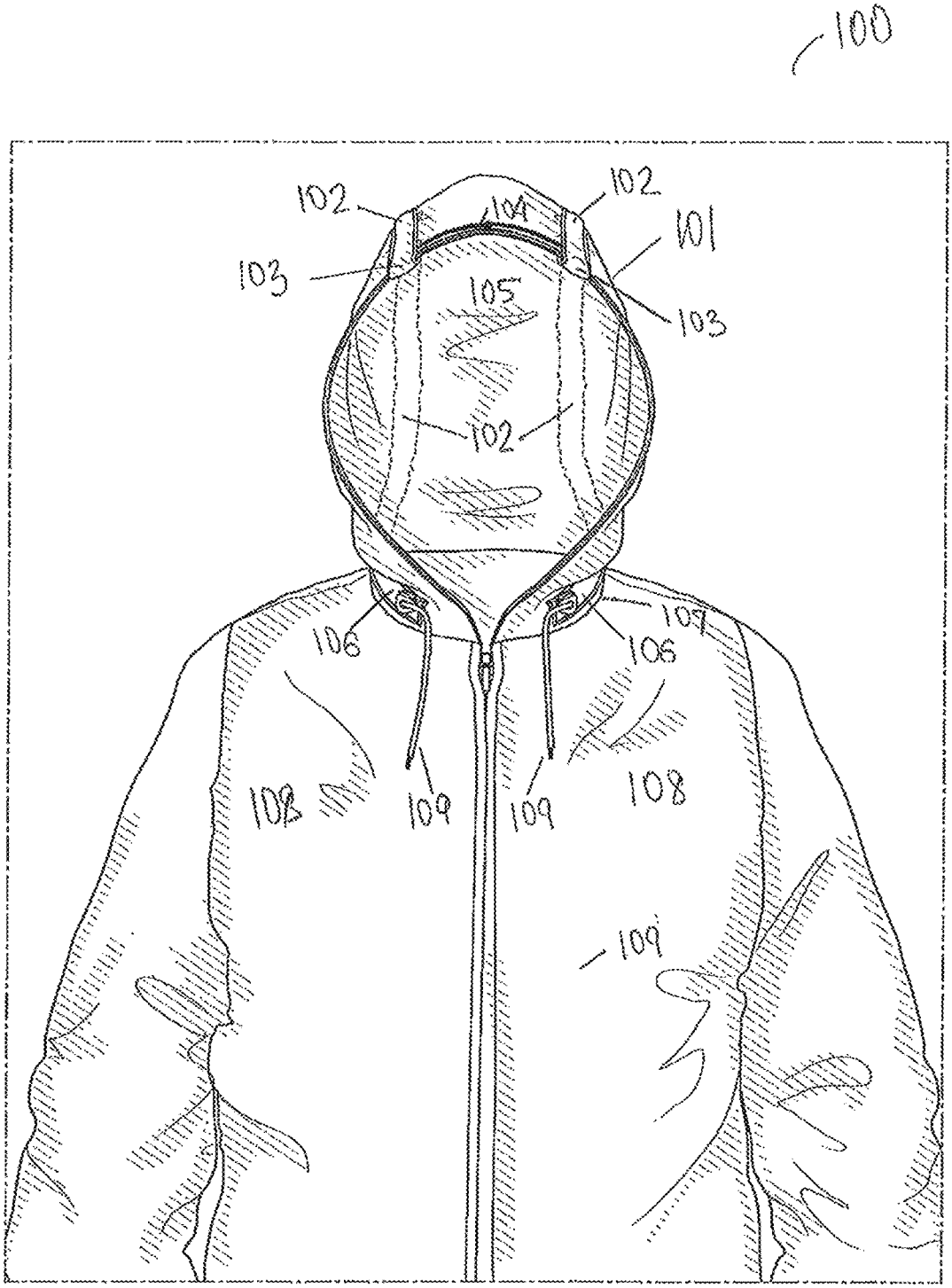
FIG. 1 presents a front view of an outerwear garment (e.g., jacket) according to at least one embodiment showing a hood thereof in its raised position.

FIG. 1 illustrates a front view of an outerwear jacket, e.g., a jacket 100 presenting a hood 101 in its raised (i.e., deployed) position and featuring drawstring passageways 102 represented in solid and dashed lines. In the preferred embodiment, each drawstring passageway 102 is shown to terminate on one end 103 at an upper edge of the brim 104 of the face opening 105 of hood 101 and terminate on one other end 106 in the front of the jacket 100, proximate to the junction of attachment of a hood base 107 and a torso portion 108 of jacket 100. The passageways 102 generally meander between ends 103 and 106 to form a concave shaped passage (when viewed from the side of the hood) with an opening facing the same direction as the opening in the hood 105. More specifically, the passages 102 begin at the front of the garment near the base 107, continue rearward over the wearer's shoulder, transitioning vertically toward the top of the hood 111, and at the top continuing forward back over the shoulder to the front of the hood at end 103.

This configuration of drawstring passageways 102 enables a wearer to remove (pull back) the hood 101 from the wearer's head by merely pulling on both free ends of the drawstrings 109. This pulling of the drawstring causes the hood to contract and thus tighten in both the vertical and horizontal directions, unlike traditional hoods that contract vertically only at the front of the hood causing the opening thereof to close thereby potentially obstructing the wearer's view. It is to be understood that the drawstrings 109 may be deployed within the drawstring passageways 102 in such ways as to enable complete detachment and extraction of drawstrings 109 from the drawstring passageways 102. For example, one free end of each of the drawstrings 109 can be attached to the upper edge of the brim 104 with a clip, button, removable fastener, and the like. Positioning of the one other end 106 of drawstring passageways 102 ensures that drawstrings 109, when secured (e.g., knotted, etc.) together to secure the upper portion of brim 104 of the face opening of the wearer (i.e., at the top of wearer's head), are not coming in contact with the chin of the wearer, thereby eliminating discomfort of the wearer and obstruction of view. While FIG. 1 illustrates only drawstring passageways 102, a person skilled in the art would understand that additional drawstring passageways (not shown) may be included in other parts of the assembly of the hood 101 to add additional functionalities to the hood 101.

Figure 2:
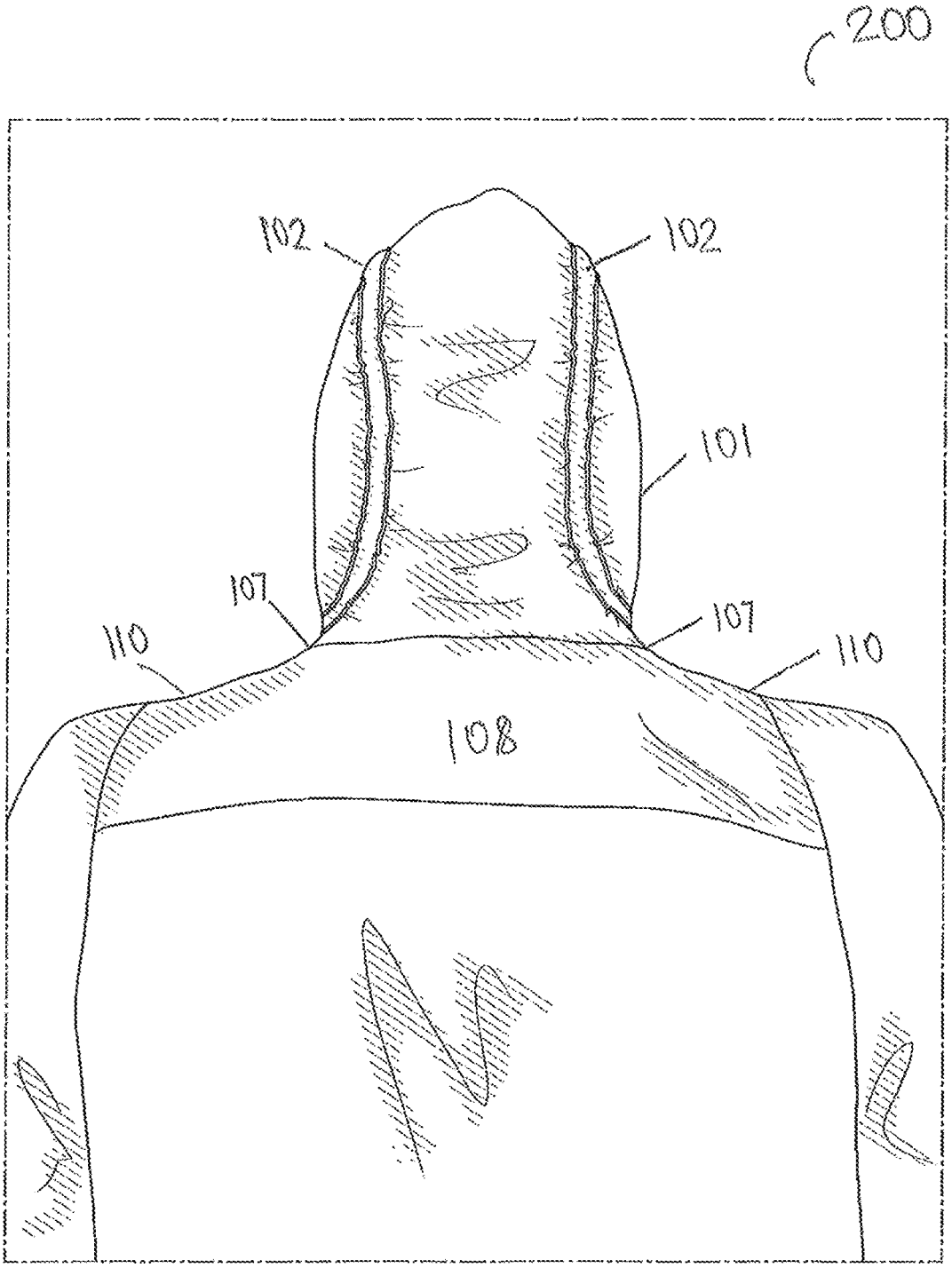
FIG. 2 presents a rear view of the jacket showing a hood in its raised position.

FIG. 2 illustrates a rear view of jacket 200 showing hood 101 in its raised (i.e., deployed) position and showing the drawstring passageways 102 extending over the top of the hood 101 (front to back), down along the back of the hood 101, and curving back over the shoulders 110 in a forward direction toward the front chest panel of jacket 200 along and in close proximity to the junction of attachment of hood base 107 and the torso portion 108 of jacket 200. It is to be understood that configuration of the drawstring passageways 102 is constructed in such a way as to eliminate or mitigate a pressure of the drawstrings 109 under tension (when pulled by a wearer) on a head or a neck of the wearer.

Figure 3:
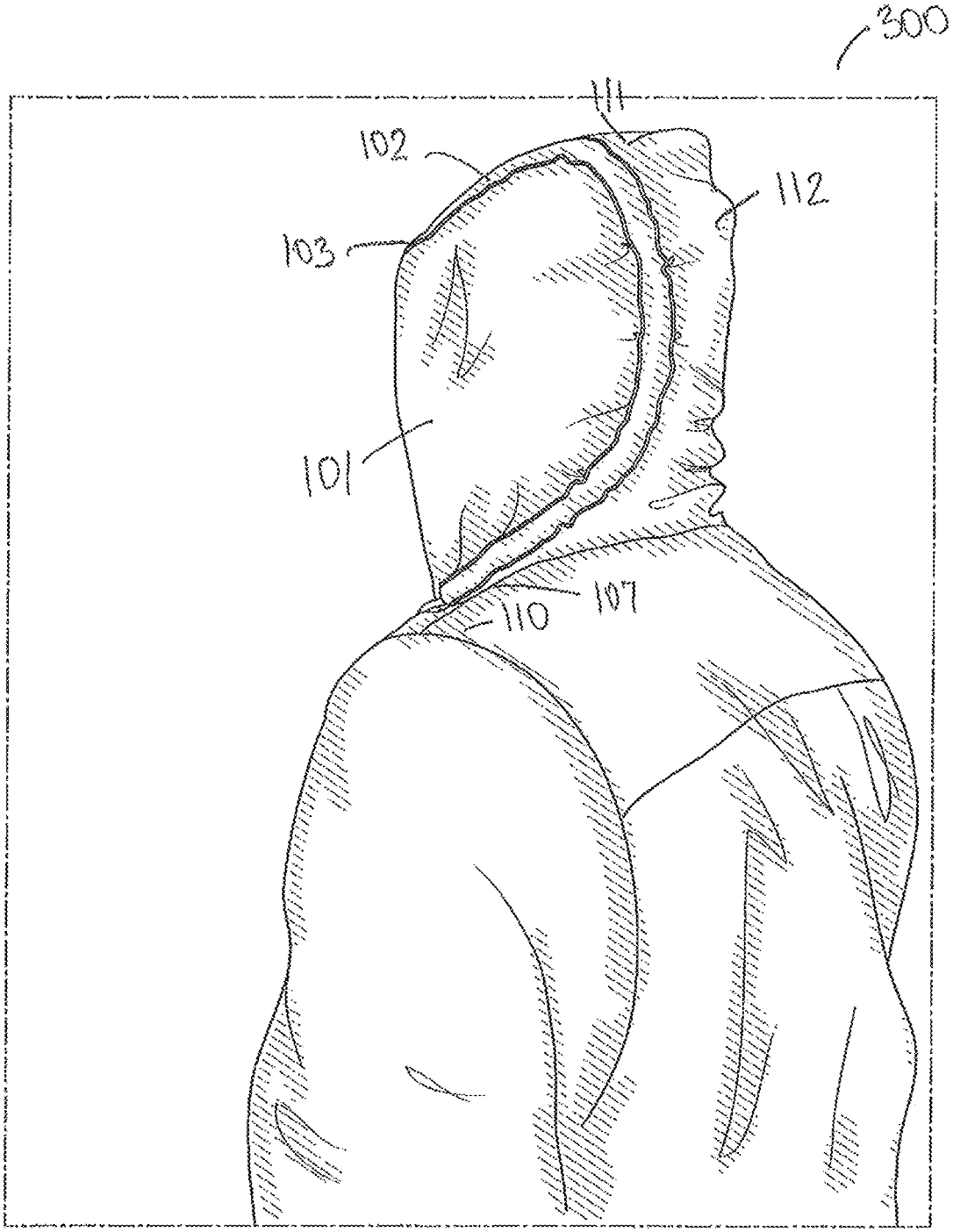
FIG. 3 presents a prospective raised rear left side view of a jacket showing a hood in its raised position.

FIG. 3 illustrates a prospective raised left side view of jacket 300 showing hood 101 in its raised (i.e., deployed) position and showing drawstring passageway 102 on the left side of hood 101, the drawstring passageway 102 terminating on one end 103 at the brim's right upper edge of the face opening of hood 101, extending rearward over the top 111 of the hood 101, down along the rear side 112 of the hood 101, and then curving back over the left shoulder 110 toward the front portion of torso portion of jacket 300 along and in close proximity to the junction of attachment of hood base 107 and the torso portion 108 of jacket 300. It is to be understood that configuration of the drawstring passageways 102 is constructed in such a way as to eliminate or mitigate a pressure of the drawstrings 109 under tension (when pulled by a wearer) on a head or a neck of the wearer.

Figure 4:
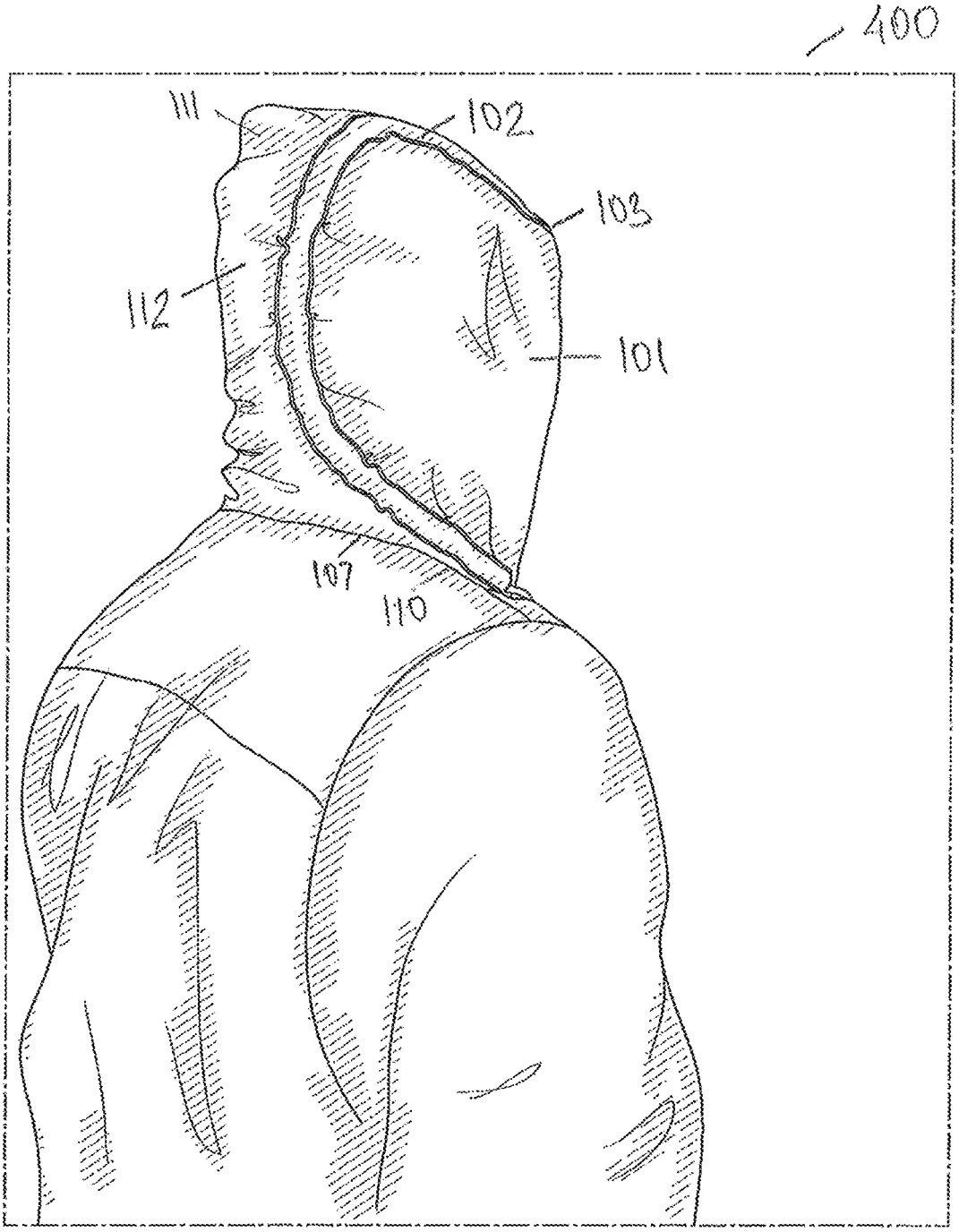
FIG. 4 presents a prospective raised rear, right-side view of a jacket showing a hood in its raised position.

FIG. 4 illustrates a mirror image of what is depicted in FIG. 3, illustrating the prospective raised right-side view of the jacket 400.

Figure 5:
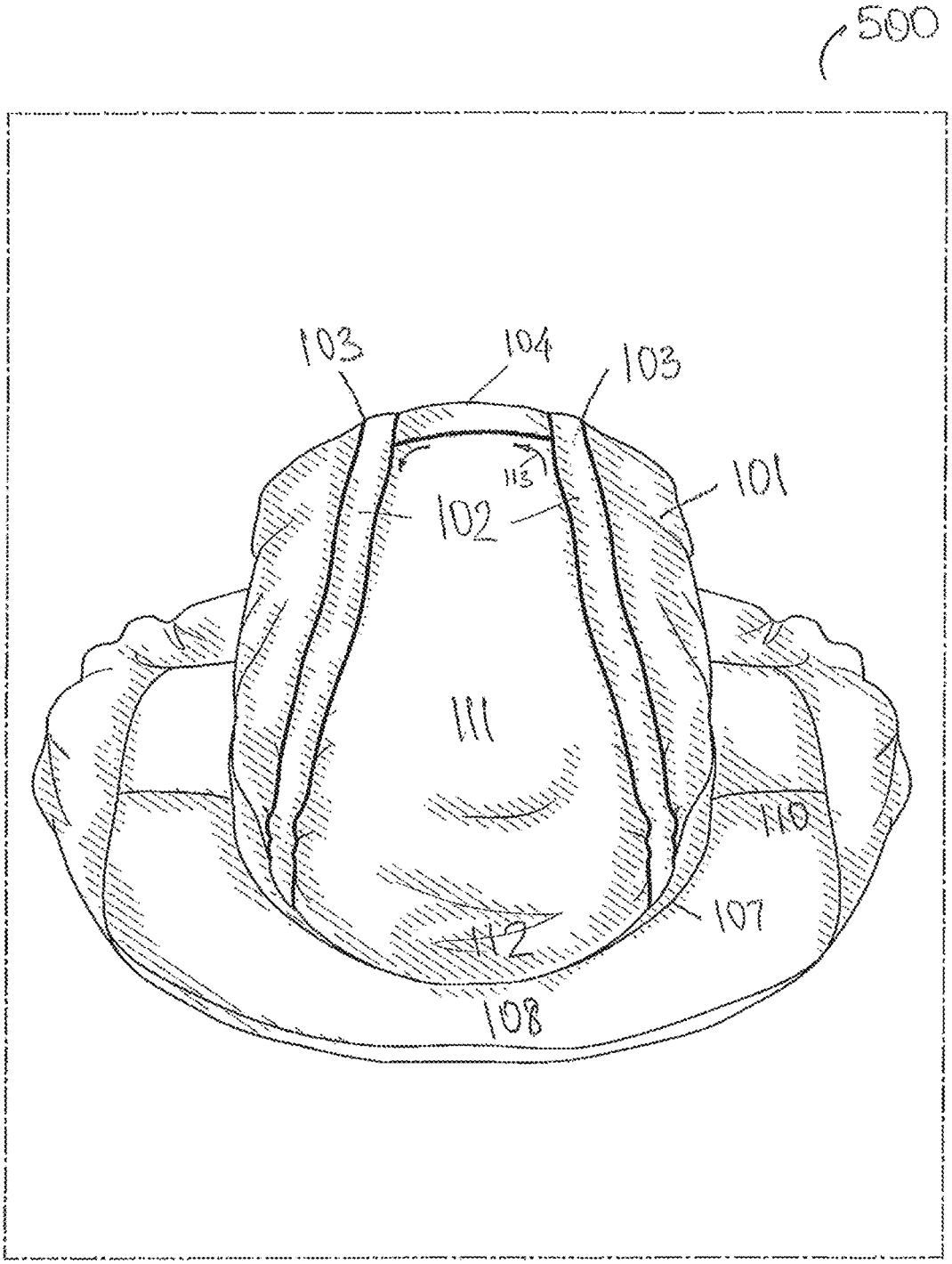
FIG. 5 presents a top view of the jacket showing a hood in its raised position.

FIG. 5 illustrates a top view of jacket 500, illustrating hood 101 having, in one embodiment, drawstring passageways 102 terminating on one end 103 at the brim's upper edge 104 of the face opening of hood 101 and extend over the top 111 of the hood 101, down to the back 112 of hood 101. In an alternative embodiment, drawstring passageways 102 do not terminate at one end 103 but form a continuous passageway along the brim's upper edge 104, illustrated by an arrow 113. In this case, there is a single drawstring extending through the passageway 102 and having two ends 106.

Figure 6:
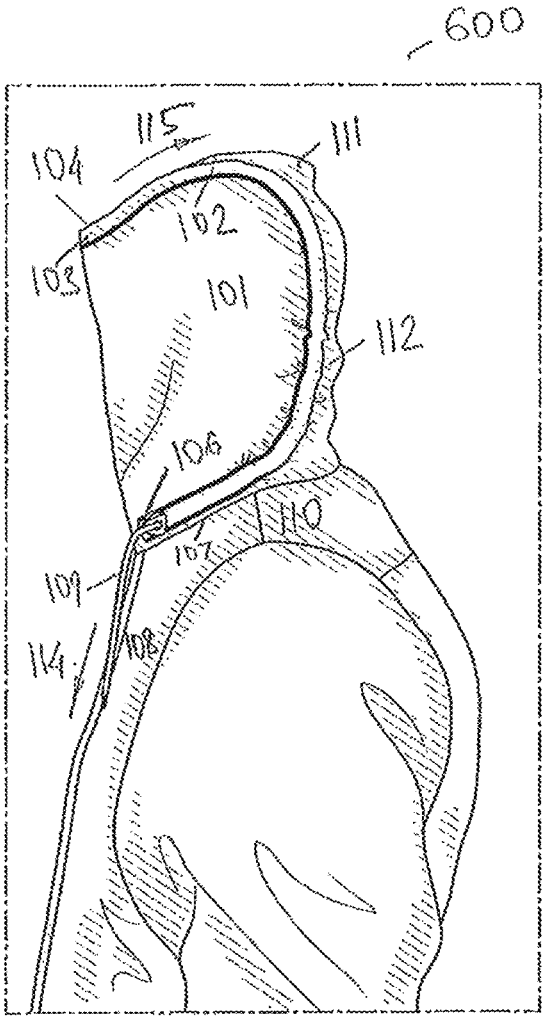
FIG. 6 presents a left-side view of the jacket showing a hood in its raised position.

FIG. 6 illustrates a left side view of jacket 600 presenting hood 101 in its raised position and showing drawstring passageway 102 on the left side of hood 101, the drawstring passageway 102 shown as extending rearward from the front 103, over the top portion 111 of the hood 101, then down toward the rear portion 112 of hood 101 and then curving back over the left shoulder 110 toward the front side of the torso portion 108 of jacket 600 along and in close proximity to the junction of attachment of hood base 107 and the front side of torso portion 108 of jacket 600.

Figure 7:
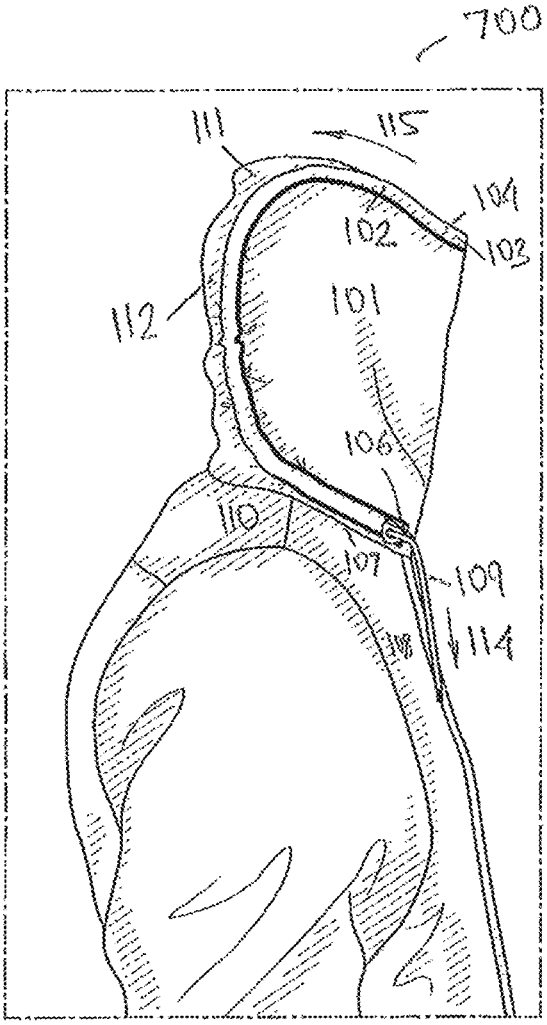
FIG. 7 presents a right-side view of the jacket showing a hood in its raised position.

FIG. 7 illustrates a right side view of jacket 700 presenting hood 101 in its raised position and showing drawstring passageway 102 on the right side of hood 101, the drawstring passageway 102 shown as extending over the top portion 111 of the hood 101, down to the rear portion 112 of hood 101 and curving back over the right shoulder 110 toward the front side of the torso portion 108 of jacket 600 along and in close proximity to the junction of attachment of hood base 107 and the front side of torso portion 108 of jacket 700.

As noted above, in an alternative embodiment, hood 101 is constructed to include a single drawstring passageway 102 originating at one end 106, extending along the upper edge of brim 104 of hood 101, and terminating at one other end 106 (best illustrated in FIG. 1). A person skilled in the art would understand that the single drawstring passageway 102 repeats a combined configuration of drawstring passageways 102, as shown in FIGS. 1-7.

The novel positioning of drawstring passageways 102 provides for tightening of the upper edge of brim 104 around the wearer's head at the forehead area such that in the tightened position hood 101 is not affected by, for example, strong wind and does not obstruct view or breathing passages of a wearer as conventional hoods tend to do. Also, a novel placement of drawstring passages 102 enables the wearer to remove hood 101 from the wearer's head using both hands by pulling drawstrings 109 downward, as shown by arrow 114 in FIGS. 6-7, causing the hood slide off the wearer's head towards the back portion of jacket and affixed in a certain position by a plastic stopper attached in such a way as to be moved up and down drawstrings 109 to be positioned as necessary at the convenience of the wearer, as illustrated by arrow 115 in FIGS. 6-7.

When drawstrings 109 are pulled to the extent that hood 101 is pulled fully off the wearer's head, the configuration of the drawstring passages 102 causes hood 101 to be folded compactly on the wearer's neck to form a cushion around the rear portion of the wearer's neck. Such cushion serves as a layer protecting the wearer from harsh weather conditions. Also, for those who wear an outerwear having the enhanced hood disclosed herein to ride a motorcycle, the cushion formed by hood 101, in its fully lowered position, servers as a cushioning layer on which the rear bottom portion of the motorcycle helmet may rest, thereby relieving a stress on the neck of the wearer from wearing a heavy motorcycle helmet.

In a preferred embodiment, the configuration of the drawstrings passageways is as such that, when drawstrings 109 are pulled to the extent that hood 101 is pulled fully off the wearer's head, the configuration of the drawstring passages 102 causes hood 101 to be folded compactly to be in close and tight contact with the lower portion of the hood to minimize entry of airstream inside the hood when a wearer of the jacket rides a motorcycle, thereby precluding or minimizing any "parachuting" effect of the hood.

In various aspects of the invention, drawstrings 109 may be elasticated cords, and the drawstrings may run in passageways 102 formed in the hood material, formed for example by adhesive application of channel strips to the interior of the hood, or by sewn channels or guides applied to the inside of hood 101.

Figures 8, 9:
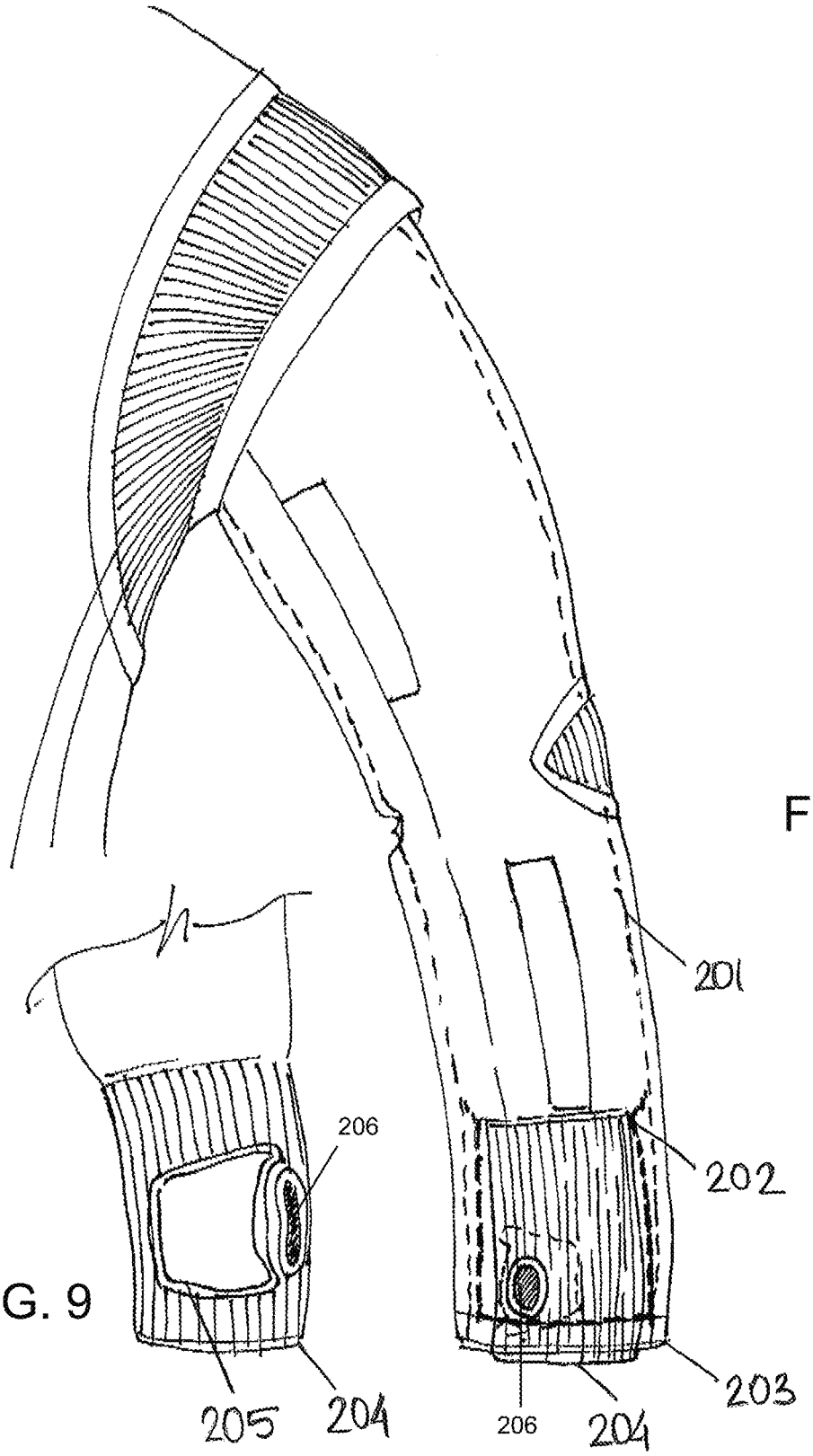
FIG. 8 presents a rear view of an appendage of a garment (e.g., sleeve of a jacket) according to at least one embodiment.
FIG. 9 presents a rear view of a lining of the sleeve according to at least one embodiment.

FIG. 8 presents a rear view of an appendage of a garment (e.g., sleeve of a jacket) according to at least one embodiment, which includes a sleeve 203. The sleeve 203 includes a sleeve lining 201. The sleeve lining is preferably made out of or includes a stretchy material and is attached at the shoulder of the jacket at a proximal end and to the cuff 204 at the distal end. The length of the lining 201 and cuff 204 combination is preferably about the length of the sleeve 203. The stretchy material in this configuration allows the user to extend the cuff 204 outward from the distal end of the sleeve 203 (causing the stretchy material to expand) when worn and the cuff 204 retracts back into the sleeve 203 when the cuff 204 is not utilized. That is, the cuff 204 is used by securing it to the user's hand, for example, by inserting the user's thumb into opening 206. When not in use, the cuff 204 remains retracted within the sleeve 203. The garment may also include a retainer 202, which is attached at the distal end of the sleeve 203 and at the proximal end of the cuff 204. The retainer 202 is preferably made from a thin lining type of a material and is so configured to prevent the sleeve lining 202 and cuff 204 from being dragged out from the sleeve 203 when the user's arm is removed from the sleeve 203. The cuff 204 is preferably made from rib knit and possesses elastic quality. The length of the cuff 204 (front to back) allows the user to wear it comfortably as a glove substitute, e.g., it covers most or all of the average user's hand. When not utilized as a glove substitute, it seals the sleeve 203 at the distal end to keep the user warm.

FIG. 9 presents a rear view of a lining of the sleeve according to at least one embodiment, which includes padding 205 located on the rear of the cuff 204. The padding 205 is preferably to be over the user's wrist and/or within the palm of the user's hand when in use. The padding 205 may include a gel insert made from "Impact Gel" with shock absorption technology. The location of the gel insert provides improved comfort and vibration\shock absorption for when the user is riding a motorcycle or holding a ski pole, etc. The gel insert may be fixed to the cuff or removably placed into a pre-made pocket within the cuff 204.

Figure 10:
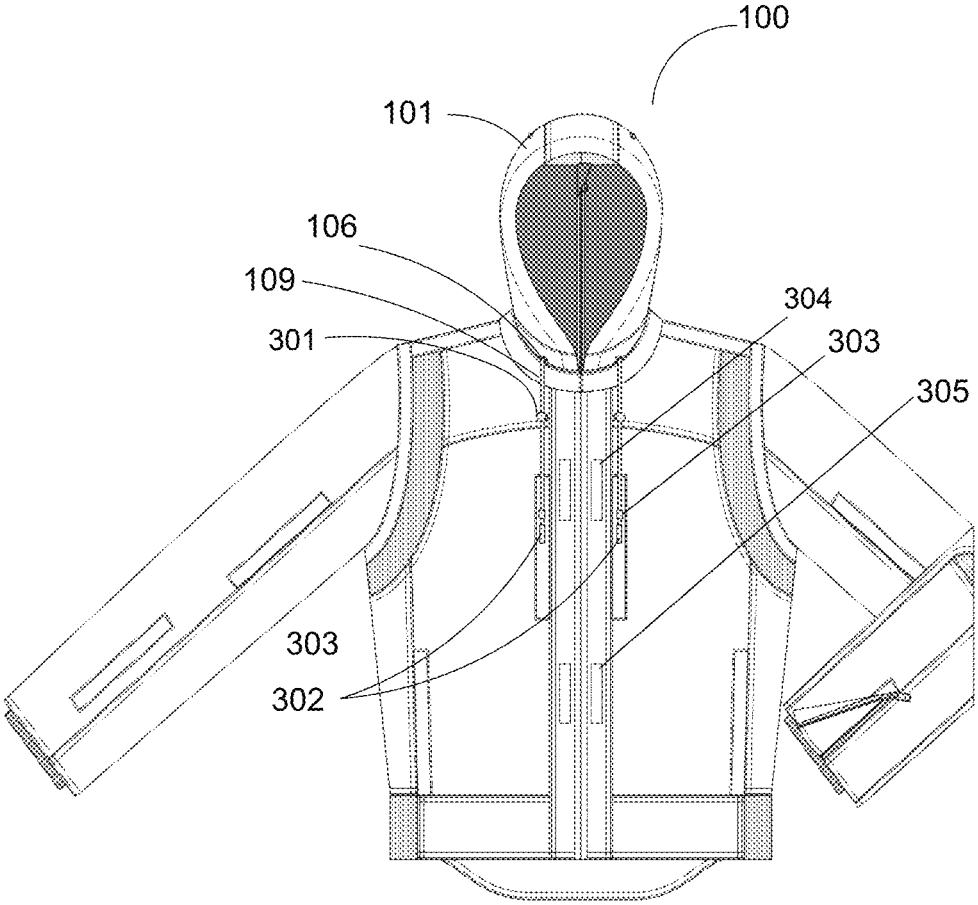
FIG. 10 presents a front view of an outerwear garment (e.g., jacket) according to at least one other embodiment showing a system for magnetically securing the drawstring to the jacket.

FIG. 10 illustrates a front view of an outerwear jacket, e.g., a jacket 100 presenting a hood 101 in its raised (i.e., deployed) position. The hood includes a drawstring passageway that terminates in openings 106 at about the neck of the hood in the front of the jacket 100, through which the drawstring 109 passes. The passageway may extend about the hood 101 as discussed herein or may simply be located around and follow the edge of the hood opening, as shown. In this embodiment, the jacket 100 includes a system for magnetically securing the terminal ends of the drawstring 109 to the jacket 100.

The securing system preferably includes one or a plurality of pairs of magnetic catch plates, such as a pair of upper catch plates 304 and a pair of lower catch plates 305. The catch plates 304, 305 are preferably magnets or material that attracts to magnets sewn into the front of the jack 100. For example, the catch plates may be sewn into the jacket laterally on either side of the zipper. When the jacket 100 includes a storm flap. The catch plates 304, 305 maybe sewn into the storm flap. The catch plates 304, 305 may be sewn onto the jacket outer layer or preferably below the outer layer so as to be covered by a least one layer of fabric. The catch plates 304, 305 may be located generally below the drawstring passage openings 106. In one embodiment, the drawstrings 109 include one or more cord stoppers 302 and may include one or more cord locks 301 to retain the hood opening in any cinched configuration. The system preferably includes one or more sliders 303 slidingly attached to the drawstring 109, between the fixed stopper 302 and the opening 106, and preferably between the stopper 302 and the cord lock 301. The slider 303 may be magnetic or of a material that attracts to magnets so as to attract or be attracted to the catch plates 304, 305. Preferably, the catch plates 304, 305 are magnetic and the slider 303 contains a ferrous material that attracts to the catch plates 304, 305. The slider 303 may be configured to slide along the drawstring 109 with some resistance so that slider 303 does not drop to the bottom of the drawstring 109 based on its own weight. The slider 303 may include a locking mechanism (not unlike a cord lock) that can be used to selectively fix the slider 303 along the length of the drawstring 109.

In operation, the upper catch plates 304 attract the slider 303 when the hood 101 is not cinched, whereas the bottom catch plates 305 attract the slider 303 when the hood is cinched or collapsed and the drawstring 109 is extended more fully. Depending on the conditions surrounding the wearer, a long or loose drawstring may create a hazardous for the wearer. A system that catches the drawstring 109 at the terminal end does not address this problem because a relatively large loop will still remain that can get caught, for example, by machinery. The variably adjustable slider 303 allows the user to control the size of the loop thus reducing such risks. Moreover, the slider 303 allows the user to adjust the position thereof so that it lands directly on the catch plate at a position that places tension in the drawstring 109 to reduce the possibility of an uncontrolled loop in the drawstring.

It is to be understood that the disclosed jacket may include various existing and novel configurations and designs attributed to outerwear. Jackets may be made out of a wide range of materials, such as natural fibers and/or synthetic materials. In some embodiments, the jacket may be made of a waterproof breathable laminate such as expanded porous polytetrafluoroethylene coated with a breathable fabric, as is well known in the art of technical outdoor garments.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range.

In the specification, the word "comprising" is used as an open-ended term, substantially equivalent to the phrase "including, but not limited to", and the word "comprises" has a corresponding meaning. Citation of references herein shall not be construed as an admission that such references are prior art to the present invention.

All publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

What is claimed is:

1. A garment comprising:

a torso portion having an upper end and a lower end, and a zipper extending vertically between the upper and lower ends of the torso portion;

a hood attached to the upper end of the torso portion, the hood having a passage therein with a first opening and a second opening at about a neck of the hood;

a first drawstring extending outward from the first opening and a second drawstring extending outward from the second opening;

a plurality of catch plates comprising a first pair of catch plates and a second pair of catch plates, the first pair of catch plates and the second pair of catch plates each being attached to the torso portion at a front end thereof, the second pair of catch plates being disposed vertically below the first pair of catch plates, the first and the second pair of catch plates each affixed to the garment laterally so that one of the pair of catch plates is affixed on either side of the zipper;

a first slider slidingly coupled to a first end of the first drawstring and a second slider slidingly coupled to a second end of the second drawstring, the first and second sliders configured to magnetically secure the first and second drawstring ends to the first pair of catch plates, wherein the first pair of catch plates are located on the front end of the torso portion of the garment to attract the first and second sliders when the hood is not cinched, and wherein the second pair of catch plates are located on the front end of the torso portion of the garment to attract the first and second sliders when the hood is fully cinched with the first drawstring and the second drawstring.

2. The garment of claim 1, comprising a cord stopper attached to each of the first and second drawstring ends.

3. The garment of claim 1, comprising a cord lock attached to each of the first and second drawstring ends.

4. The garment of claim 3, wherein the first and second sliders are located between the respective cord lock and a cord stopper attached to each of the first and second drawstring ends.

5. The garment of claim 1, wherein the first slider and the second slider are slidingly coupled to each of the first and second drawstrings with a resistance fit to prevent the slider from dropping along the drawstring based on its own weight.

6. The garment of claim 1, wherein the passage meanders from the first opening in a concave shape on at least a first side of the hood and extending from a bottom front of the hood, rearward over a wearer's shoulder when the hood is worn by a wearer, transitions vertically toward a top of the hood, and continues at the top of the hood forward back over the wearer's shoulder toward the front of the hood when the hood is worn by the wearer, and terminates at a front edge of a brim of the hood, and wherein at least a portion of each of the first and second drawstrings is disposed within the passage.

7. The garment of claim 6, wherein the passage meanders from the second opening in a concave shape on at least a side of the hood opposite the first side of the hood and extending from the bottom front of the hood, rearward over a wearer's shoulder when the hood is worn by the wearer, transitions vertically toward the top of the hood, and continues at the top of the hood forward back over the wearer's shoulder toward the front of the hood when the hood is worn by the wearer, and terminates at the front edge of a brim of the hood.

8. The garment of claim 7, wherein the passage on the first side has a curvature that mirrors a curvature of the opposite, second side of the passage.

9. The garment of claim 1, wherein each of the first and second drawstrings comprises a pair of drawstring halves detachably connected at a front edge of a brim of the hood.

10. The garment of claim 1, comprising a sleeve and a sleeve lining attached at one end thereof to the sleeve at a proximal end of the sleeve, the sleeve lining extendible outward sufficient to cover at least a portion of a wearer's hand and configured to be retractable inward at a distal end of the sleeve.

11. The garment of claim 10, comprising a retainer having a first end attached at the distal end of the sleeve to the sleeve and to the sleeve lining, the retainer limiting at least retractable inward movement of the sleeve lining.

12. The garment of claim 10, comprising a cuff at the distal end of the sleeve lining.

13. The garment of claim 12, the cuff comprising padding adapted to be disposed about the wearer's palm.

14. The garment of claim 13, wherein the padding is removably coupled to the cuff.

* * * * *